US010655330B2

(12) United States Patent
Keshet et al.

(10) Patent No.: US 10,655,330 B2
(45) Date of Patent: May 19, 2020

(54) MODULAR STORMWATER MANAGEMENT DEVICE AND SYSTEM

(71) Applicants: Yair Y. Keshet, Gladwyne, PA (US); Elizabeth L. Keshet, Gladwyne, PA (US)

(72) Inventors: Yair Y. Keshet, Gladwyne, PA (US); Elizabeth L. Keshet, Gladwyne, PA (US)

( * ) Notice: Subject to any disclaimer, the term of this patent is extended or adjusted under 35 U.S.C. 154(b) by 0 days.

(21) Appl. No.: 15/583,995

(22) Filed: May 1, 2017

(65) Prior Publication Data

US 2017/0314223 A1 Nov. 2, 2017

Related U.S. Application Data

(60) Provisional application No. 62/329,361, filed on Apr. 29, 2016.

(51) Int. Cl.

| | |
|---|---|
| ***E02B 11/02*** | (2006.01) |
| ***E04D 11/00*** | (2006.01) |
| ***E03F 1/00*** | (2006.01) |

(52) U.S. Cl.

CPC ..... *E04D 11/005* (2013.01); *E03F 1/00* (2013.01)

(58) Field of Classification Search

CPC .... E01C 5/00; E02B 11/02; E03F 1/00; E03F 5/0404; E03F 5/16; E04D 11/005

See application file for complete search history.

(56) References Cited

U.S. PATENT DOCUMENTS

| | | | | |
|---|---|---|---|---|
| 6,140,550 | A | 10/2000 | Beihoffer et al. | |
| 6,606,823 | B1 | 8/2003 | McDonough et al. | |
| 7,767,878 | B2 | 8/2010 | Suzuki | |
| 8,647,734 | B2 | 2/2014 | Keene | |
| 9,393,546 | B2 | 7/2016 | Ito et al. | |
| 2007/0243820 | A1* | 10/2007 | O'Hagin | F24F 7/025 454/365 |
| 2009/0188172 | A1 | 7/2009 | DuCharme et al. | |
| 2010/0325975 | A1* | 12/2010 | Mischo | E04D 7/005 52/173.3 |
| 2016/0108621 | A1 | 4/2016 | Zwier et al. | |

* cited by examiner

*Primary Examiner* — Carib A Oquendo
(74) *Attorney, Agent, or Firm* — Eric S. Barr

(57) ABSTRACT

Systems and modular devices for roof or ground-level stormwater management are disclosed. A modular stormwater management device includes a water retention mat structured to absorb stormwater, a rigid frame structured to support the water retention mat, and a perforated surface structured to permit drainage of the stormwater from the water retention mat through the perforated surface. A modular stormwater management system includes a plurality of modular stormwater management devices, each of the modular stormwater management devices including a water retention mat structured to absorb stormwater, a rigid frame structured to support the water retention mat, and a perforated surface structured to permit drainage of the stormwater from the water retention mat through the perforated surface.

15 Claims, 11 Drawing Sheets

100

500

900

900

900

MODULAR STORMWATER MANAGEMENT DEVICE AND SYSTEM

CROSS-REFERENCE TO RELATED APPLICATION

This application claims priority to and the benefit of U.S. Provisional Patent Application No. 62/329,361, filed on Apr. 29, 2016, the disclosure of which is incorporated by reference herein in its entirety.

BACKGROUND

The present invention generally relates to stormwater management and, more particularly, to a modular device and system for roof or ground-level stormwater management.

As urban and suburban areas develop and transform once permeable land into impermeable surface, either as buildings, urban infrastructure, roadways, or parking facilities, water from rain and storm events moves much more quickly and directly into municipal storm drains and into natural streams and creeks. In urban areas, storm events may be costly to home and business owners and damaging to the environment. In suburban areas, increased runoff contributes to intensified stream-flow and the eroding of hillsides and creek banks, both of which may destabilize homes and infrastructure and disturb natural habitats. In large storm events, excess runoff may contribute to overflows from combined sewer systems (i.e., storm and sanitary), pollution of rivers with fertilizers, sewage, oil and sediment, destruction of aquatic and riparian habitats, and property damage.

Combined sewer overflows occur when surge events in stormwater create situations in which the mix of stormwater and sewage that normally stays below ground and is routed to a treatment facility instead backs up into streets, overflows into rivers, or even backs up in basement plumbing outlets.

Rivers and streams are polluted as stormwater moves quickly across impermeable surfaces, such as roadways and parking lots, collecting oils and chemicals and washing them directly into rivers. Permeable ground slows the flow of water, which then picks up less sediment and slowly seeps through the ground, which acts as a filter.

Wildlife habitats may be destroyed as the sediments and oils are picked up and washed into streams and rivers. The banks of streams and creeks may also be transformed in high-flow events, disturbing natural wildlife conditions.

Property damage may occur as stormwater runoff overwhelms the municipal infrastructure and water or a mix of water and sewage backs up into streets and basements. The flooding is both damaging and unsanitary. Municipal infrastructure is also at risk, as more stress is placed on aging stormwater systems.

Because of the damaging effects of excess stormwater, municipalities are increasingly focused on developing solutions that rely on both public and private investment to manage stormwater. Faced with either upgrading or replacing their stormwater systems to handle the increased demand (a costly and politically challenging expense) or implementing policies that regulate and mitigate increased non-permeable areas, most municipalities choose the latter.

Local municipalities are also held accountable for the effects of their runoff by the federal government. The Clean Water Act, passed by Congress in 1972, establishes water quality standards for surface water. States enforce these standards by regulating combined storm-sewer overflow points and regulating runoff in areas with separated sewer systems.

Public investment often involves strategies of "greening" cities by increasing plant life along street frontages and within parks. Trees, bushes, and other plant life can remove significant amounts of water from the ground surface.

Private investment in stormwater management is encouraged in primarily two ways: through stormwater fees and through development regulations and incentives.

While municipalities have a range of policies regarding stormwater fees, generally they are implemented in similar ways. Commercial properties may be charged a square-foot cost for all the impermeable square feet located on their property. This encourages them to either build less or to retrofit an existing structure or surface lot to contain more permeable land. Residential property owners may be charged a flat rate based on the average impermeable surface area throughout residential properties in the city. Some municipalities, such as Washington D.C., have stormwater credit markets in which properties owners may receive credits by increasing their stormwater retention and then sell those credits to other owners who may use them to meet minimum requirements.

Stormwater fees may help cover the cost of maintaining the runoff system while also incentivizing property owners to increase their permeable surface area.

Properties being newly developed may be subject to an increasing amount of regulations and municipal scrutiny with regard to stormwater management. For example, in Philadelphia, any new development that disturbs over 15,000 SF of earth triggers Philadelphia Water Department (PWD) regulations. Generally, stormwater regulations require projects to manage the first inch of stormwater runoff on their property onsite. Architects, civil engineers, and their clients can propose a range of solutions to manage the water, but the design must be reviewed and approved by the PWD Stormwater Plan Review office before any permits can be issued for the project's construction.

Developers are also incentivized by many municipal zoning bonuses that can be activated by incorporating stormwater management strategies. When developing a property, the possibility of additional stories, lot coverage or an easing of massing restrictions effectively motivates developers to incorporate green roofs and other stormwater management strategies.

There are currently many methods to manage stormwater onsite. In large suburban areas, retention ponds, landscaped swales, and rain gardens may capture runoff and provide a permeable area with plant life to allow water to deeply infiltrate the earth or be used and eventually transpired by the plant life.

In urban areas, more compact methodologies are generally employed. The most commonly used systems include water cisterns, blue roofs, subsurface detention, and green roofs.

Water cisterns are large storage tanks, located above or below ground, that hold rainwater for reuse or later drainage. These may drain by gravity or may require a pump. Their installation may be inexpensive, though often they are employed underground, requiring an expensive pump to move the water into its new use or the stormwater system. To meet municipal requirements, they often must be combined with filters that must be maintained and inspected. Cisterns located above ground must also be monitored in freeze-thaw temperature cycles. They do not minimize the urban heat island effect.

Blue roofs may provide temporary storage of stormwater on flat roofs by check dams or by restricting the roof drains. Water held during a rain event may then be drained once the storm surge is over. While fairly inexpensive to install, a blue roof tests the waterproofing of a roof by allowing a body of water to sit on the roof, which roof design standards usually seek to avoid. Regular inspections are required of both the roof surface and drains. There are also negatives associated with allowing a still body of water to sit within urban areas, especially as mosquito-borne illness continues to be a growing concern throughout North America.

Subsurface detention methods are underground structures that may be used to temporarily hold and later release stormwater. These may include vaults, stone storage systems, pipe systems or systems of plastic grids. For emergency flooding, in 100 year flood events and the like, many large institutions may repurpose their underground parking facilities to hold stormwater, essentially intentionally flooding a basement (or basements) to mitigate flooding on the floors above. These systems often must be combined with other management strategies to meet water quality requirements and may be costly to install and maintain.

A common stormwater management strategy is a green roof. While there are many variations in green roof design, green roofs generally include a plastic tray with soil and plant life that is placed over a water retention mat and filter fabric along with some form of integrated drainage and water storage. Green roofs may help with stormwater by holding water that would otherwise leave the roof through downspouts for a period of time, either to drain out later or to be used by the plants.

Green roofs may offer other benefits beyond stormwater management, and are often seen as a building amenity. However, green roofs are expensive to install and maintain. Their success is not guaranteed and is dependent on ongoing maintenance, often times involving irrigating the green roof during dry spells. If the plant life dies, many of the benefits of the green roof may disappear, including benefits related to minimizing stormwater, mitigating the effects of urban heat islands, and increasing wildlife.

Another disadvantage for green roofs, from a building owner's perspective, is that if the roof leaks, it may be difficult to discover the source of the leak without tearing out much of the established plant life.

The weight of a green roof may negate it from consideration for retrofits to older buildings. There exist large swaths of urban buildings with flat roofs that were not designed to support the added weight of a green roof.

SUMMARY

In a first aspect of the invention, there is a modular stormwater management device that includes: a water retention mat structured to absorb stormwater; a rigid frame structured to support the water retention mat; and a perforated surface structured to permit drainage of the stormwater from the water retention mat through the perforated surface.

In another aspect of the invention, there is a modular stormwater management system that includes: a plurality of modular stormwater management devices, wherein each of the plurality of modular stormwater management devices includes: a water retention mat structured to absorb stormwater; a rigid frame structured to support the water retention mat; and a perforated surface structured to permit drainage of the stormwater from the water retention mat through the perforated surface.

In another aspect of the invention, there is a stormwater management device that includes: a water retention mat structured to absorb stormwater; and a breather fabric, wherein the breather fabric is laminated to the water retention mat.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

The present invention generally relates to stormwater management and, more particularly, to a modular device and system for roof or ground-level stormwater management. Aspects of the invention provide a compact, modular stormwater management device and system that may be structured to absorb, hold, and later release stormwater. According to an embodiment, the modular stormwater management device and system may be lightweight, easy to install, and easy to maintain. According to an embodiment, the modular stormwater management device and system may have a decreased weight, as compared to plant-based systems, allowing it to be utilized in applications that cannot support the weight of soil and plant life, such as retrofits to older buildings with flat roofs that were not designed to support the added weight of a green roof.

Aspects of the invention may decrease the installation and maintenance cost of stormwater management systems, allowing a lower tier of development and institutional management to incorporate stormwater management strategies. Other aspects of the invention may discourage mosquitoes from breeding by absorbing stormwater rather than allowing it to pool. Aspects of the invention may also lower the likelihood of roof leaks by preventing water from flowing to the weakest point of a roof membrane.

As described herein, aspects of the invention may include a modular stormwater management device including: a water retention mat structured to absorb stormwater; a rigid frame structured to support the water retention mat; and a perforated surface structured to permit drainage of the stormwater from the water retention mat through the perforated surface.

Other aspects of the invention may include a modular stormwater management system that includes: a plurality of modular stormwater management devices, wherein each of the plurality of modular stormwater management devices includes: a water retention mat structured to absorb stormwater; a rigid frame structured to support the water retention mat; and a perforated surface structured to permit drainage of the stormwater from the water retention mat through the perforated surface.

Other aspects of the invention may include a stormwater management device that includes: a water retention mat structured to absorb stormwater; and a breather fabric, wherein the breather fabric is laminated to the water retention mat.

Figure 1:
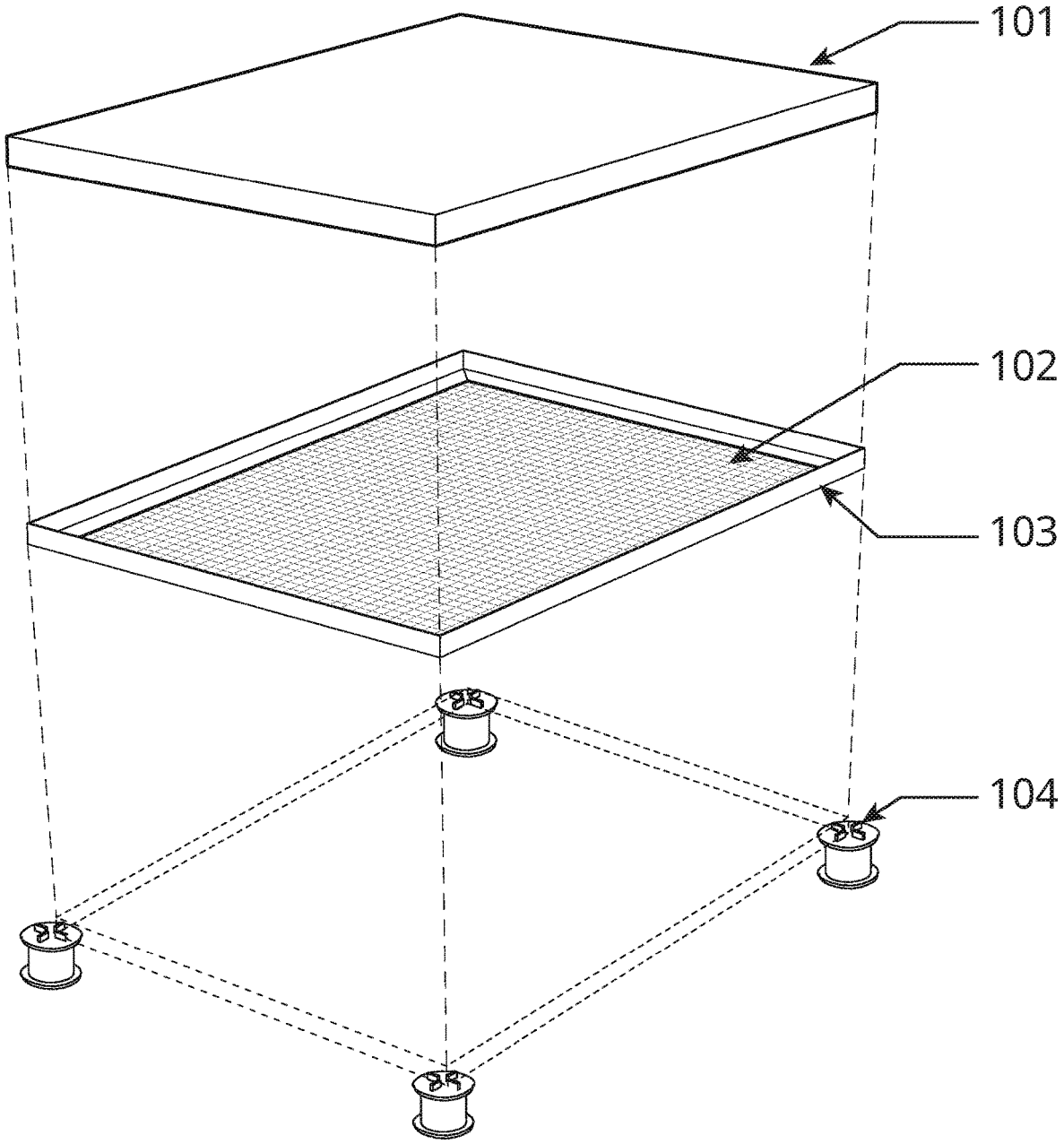
FIG. 1 shows an exploded axonometric projection view of a modular stormwater management device according to an embodiment of the present invention.

FIG. 1 shows an exploded axonometric projection view of a modular stormwater management device 100 according to an embodiment of the present invention. The modular stormwater management device 100 may be structured as a panel system as shown in FIG. 1. One or more modular stormwater management devices 100 may function as a compact stormwater management system. According to an embodiment, the modular stormwater management device 100 includes a water retention mat 101. The water retention mat 101 may be formed from a fabric of needle-punched polypropylene or polyester, or a combination thereof, or alternatively, from an engineered sponge. The engineered sponge may be comprised of polyvinyl alcohol (PVA) and have very absorbent properties and anti-microbial attributes, a cellulose sponge, or any similar absorbent synthetic sponge. The water retention mat 100 may be formed from a material that is resistant to degradation due to solar/UV radiation.

According to an embodiment, the water retention mat 101 may be fitted into a rigid frame 103 that is made of metal, wood, plastic, or another suitable rigid material. The rigid frame 103 may be structured to hold the water retention mat 101 in place. A metal or plastic mesh or rigid perforated sheet of metal or plastic 102 may be held within the rigid frame 103 on which the water retention mat 101 is supported. This mesh or perforated sheet 102 according to an embodiment may have a high ratio of openings to surface area in order to facilitate maximum air flow underneath the water retention mat 101. Openings in the water retention mat 101 may be configured to allow for air, water, and water vapor to permeate around the water retention mat 101. These openings in the water retention mat 101 may allow water to enter and exit the material effectively and prevent mold or mildew from forming within the water retention mat 101. The opening in the mesh or rigid perforated sheet 102 may also prevent excess water that is not absorbed in the water retention mat 101 from pooling around the water retention mat 101.

According to an embodiment, the modular stormwater management device 100 comprised of the water retention mat 101, the mesh or perforated sheet 102, and the rigid frame 103 may be fitted into roof or paver pedestals 104. The roof or paver pedestals 104 may be existing components of a building's roof or may be provided as a component of the modular stormwater management device 100. The roof or paver pedestals 104 may be structured to hold the modular stormwater management device 100 several inches above the roof surface on which the modular stormwater management device 100 is installed in order to enhance air circulation around the modular stormwater management device 100 and to allow for easy maintenance and visibility of the roof surface below the modular stormwater management device 100. The roof or paver pedestals 104 may be comprised of plastic or metal with sufficient strength to support the rigid frame 103, the mesh or perforated sheet 102, the water retention mat 101, and the weight of the maximum amount of water capable of being stored within the water retention mat 101. According to another embodiment, the modular stormwater management device 100 may have integrated feet, rather than utilizing the roof or paver pedestals 104.

Additionally, according to an embodiment, a filter fabric (not shown) may be integrated into either the water retention mat 101, the mesh or perforated sheet 102, or both to improve water quality and extend the life of the water retention mat 101. The filter fabric may prevent small particles, such as dirt and soot, from entering the water retention mat 100 and making the water retention mat 100 less porous to air and water. The filter fabric may be made of a geotextile, either woven or non-woven, with high hydraulic conductivity by permittivity.

Figure 2:
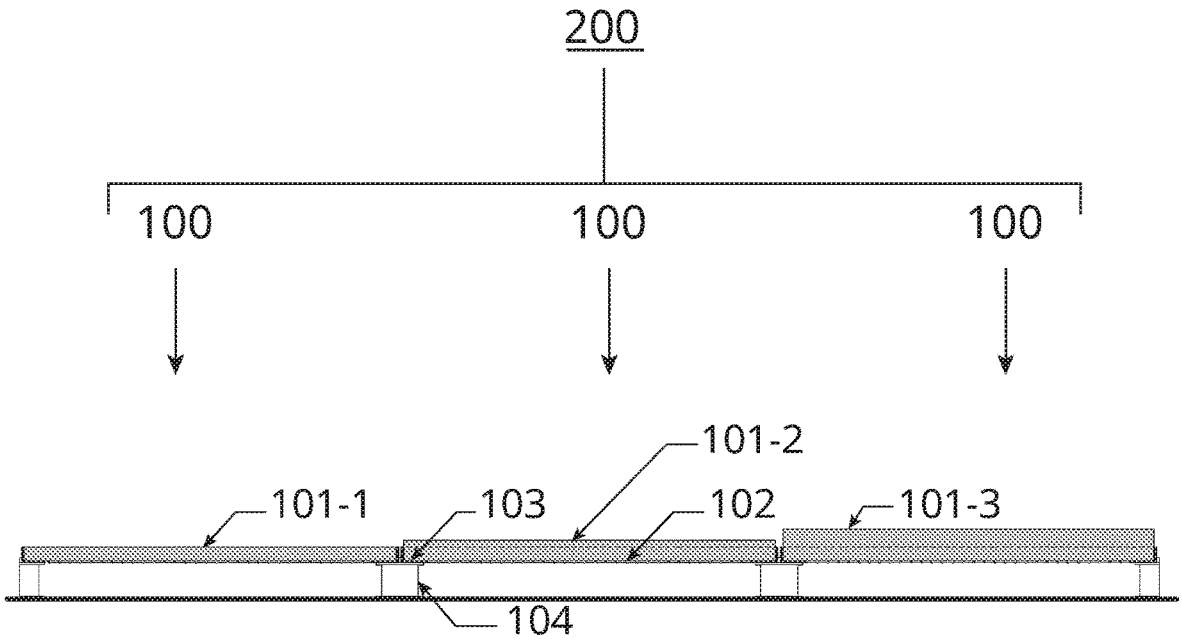
FIG. 2 shows a section view of a modular stormwater management system according to an embodiment of the present invention.

FIG. 2 shows a section view of a modular stormwater management system 200 according to an embodiment of the present invention. The modular stormwater management system 200 may include a plurality of the modular stormwater management devices 100 illustrated in FIG. 1. The modular stormwater management system 200 may include modular stormwater management devices 100 having water retention mats 101-1, 101-2, 101-3 in one or more thicknesses. The thickness of the water retention mats 101-1, 101-2, 101-3 may be determined based upon desired water retention properties in order to best suit different applications. According to an embodiment, the thicknesses of the water retention mats 101-1, 101-2, 101-3 may range from ½" to 12" thick. The thicker the water retention mat 101-1, 101-2, 101-3, the more water it may retain, however increased thickness may also result in the held water taking a longer time to dissipate through evaporation.

According to an embodiment, a thicker water retention mat such as water retention mat 101-3 may be selected for use in a dry climate that experiences flash flood events and in which evaporation occurs at a fast rate. In such a climate, the thicker water retention mat 101-3 may be desirable because it may mitigate the effects of a flash flood. On the other hand, according to an embodiment, a thinner water retention mat such as water retention mat 101-1 may be selected for use in a humid climate, thereby increasing the surface area to water storage volume ratio.

While thicker water retention mats such as water retention mat 101-3 may be desirable for climatic reasons, applications onto existing structures must take into account the weight capacity of the existing structure. Accordingly, a thinner water retention mat such as water retention mat 101-1 may be necessary to limit the overall weight load when fully permeated with water. Overall, the thickness of the water retention mat 101-1, 101-2, 101-3 may be determined by the climate of the installation, the desired amount of water retention, the desired length of time the water is retained, and the structural load capacity of the surface on which the modular stormwater management system 200 is installed.

The modular stormwater management system 200 may be configured such that all of the modular stormwater management devices 100 have water retention mats 101-1, 101-2, 101-3 of the same thickness. According to another embodiment, the thickness of the water retention mats 101-1, 101-2, 101-3 may vary between individual modular stormwater management devices 100 in the modular stormwater management system 200 based upon absorption and evaporation requirements and structural load capacity at particular locations in the modular stormwater management system 200.

While the modular stormwater management devices 100 in the modular stormwater management system 200 also release water through draining, increasing the amount of evaporation positively affects air temperature. Accordingly, an embodiment of the modular stormwater management system 200 may mitigate the heat island effect experienced in many urban environments.

The rigid frame 103 may be structured to support the water retention mats 101-1, 101-2, 101-3 in combination with a mesh or perforated sheet 102 as well as providing an attachment structure that allows for attachment of the modular stormwater management device 100 to a roof or paver pedestal 104.

Figure 3:
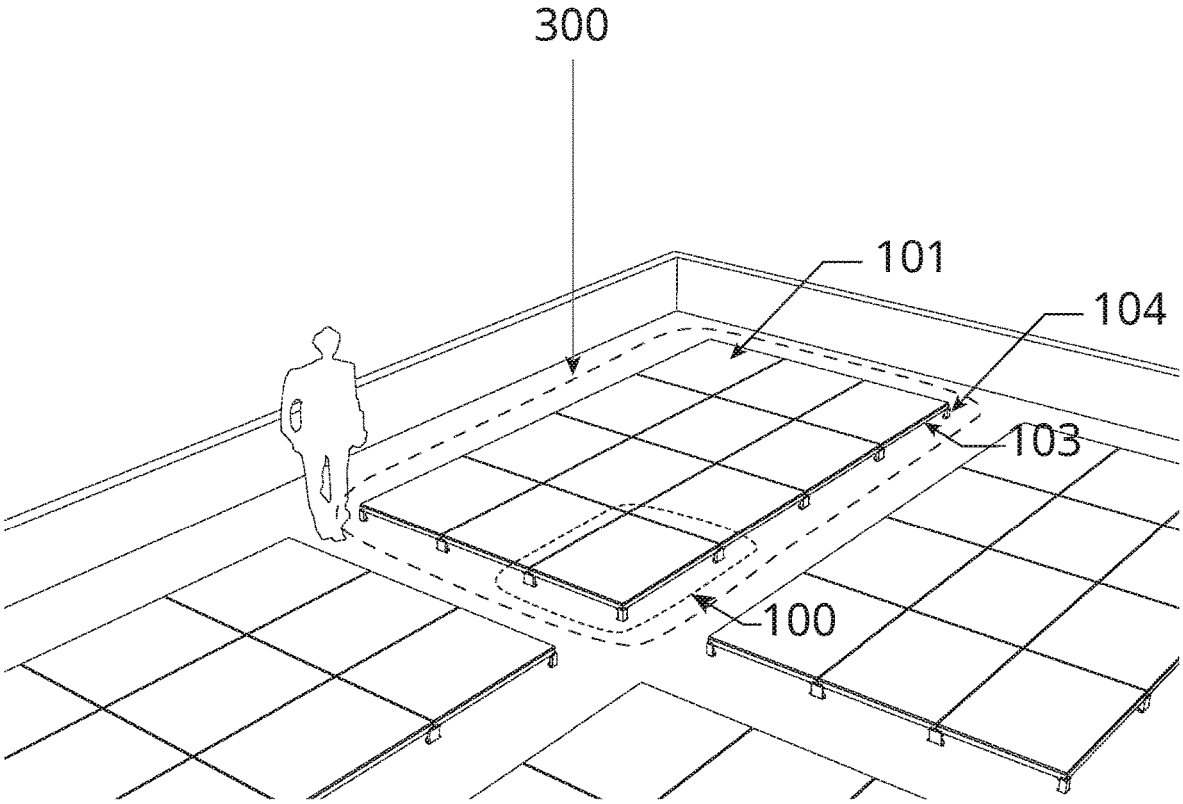
FIG. 3 shows a perspective view of a modular stormwater management system installed on a building rooftop according to an embodiment of the present invention.

FIG. 3 shows a perspective view of a modular stormwater management system 300 installed on a building rooftop according to an embodiment of the present invention. The modular stormwater management system 300 may include a plurality of the modular stormwater management devices 100 illustrated in FIG. 1. While the modular stormwater management system 300 is shown in FIG. 3 on a flat roof, the modular stormwater management system 300 may be utilized on a multitude of surfaces, including on roofs and facades, at the ground, and on flat or sloped surfaces. According to an embodiment, the plurality of the modular stormwater management devices 100 included in the modular stormwater management system 300 may include the water retention mat 101, the mesh or perforated sheet 102 (not visible in FIG. 3), and the rigid frame 104 and may be laid out individually or in a grid, as shown in FIG. 3. The dimensions of the modular stormwater management devices 100 and the number of the modular stormwater management devices 100 arrayed may vary based on the application.

The number of modular stormwater management devices 100 according to an embodiment may vary based on the desired amount of water retention or the desired amount of square-foot coverage. For example, in some applications, coverage of only partial areas of a ground surface or roof by the modular stormwater management devices 100 may be desirable, either to meet municipal requirements and incentives or to mitigate heat gain on the surface. The sizes of the modular stormwater management devices 100 may vary as well, as the surface may have obstructions or may not be shaped as a rectangle. Larger modular stormwater management devices 100 may be employed if construction methods allow for easy transportation to the site, such as ground level applications or roof applications with convenient access to a crane. Other installations may require the sizes of the modular stormwater management devices 100 to be small enough to be carried through conventional doors, roof openings, lifts, or stairs in order to get to the installation site.

Figure 4:
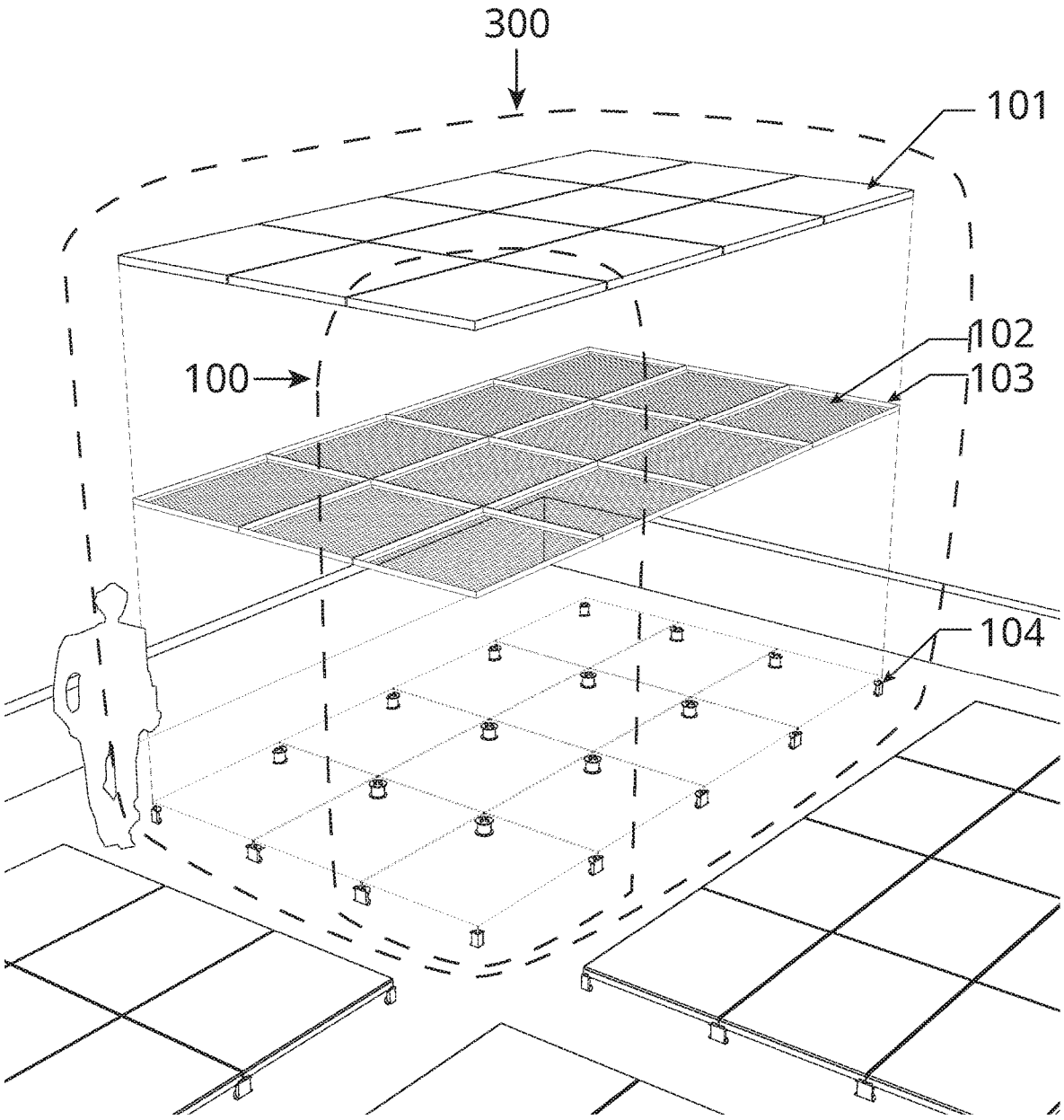
FIG. 4 shows an exploded axonometric projection view of a modular stormwater management system installed on a building rooftop according to an embodiment of the present invention.

FIG. 4 shows an exploded axonometric projection view of the modular stormwater management system 300 installed on a building rooftop according to an embodiment of the present invention. The modular stormwater management system 300 may include a plurality of the modular stormwater management devices 100 illustrated in FIG. 1. As illustrated in FIG. 4, according to an embodiment, the rigid frames 103 and the mesh or perforated sheets 102 may nest together into an efficient grid system for ease of installation and to maximize coverage over a surface. By nesting together or sharing compatible geometries, the modular stormwater management devices 100 are able to be installed as closely together as possible. Accordingly, the modular stormwater management system 300 may be structured to minimize the amount of water that falls on the surface between the modular stormwater management devices 100 and that is not caught in the water retention mats 101. The water retention mats 101 may be installed over the mesh or perforated sheets 102 and may fit into the rigid frames 103. According to an embodiment, the roof or paver pedestals 104 may be arranged to support several modular stormwater management devices 100 in combination. The rigid frames 103 may also have integrated feet, therefore avoiding the need for the roof or paver pedestals 104. The dimensions of the modular stormwater management devices 100 and the number of modular stormwater management devices 100 arrayed in the modular stormwater management system 300 may vary based on the application.

Figure 5:
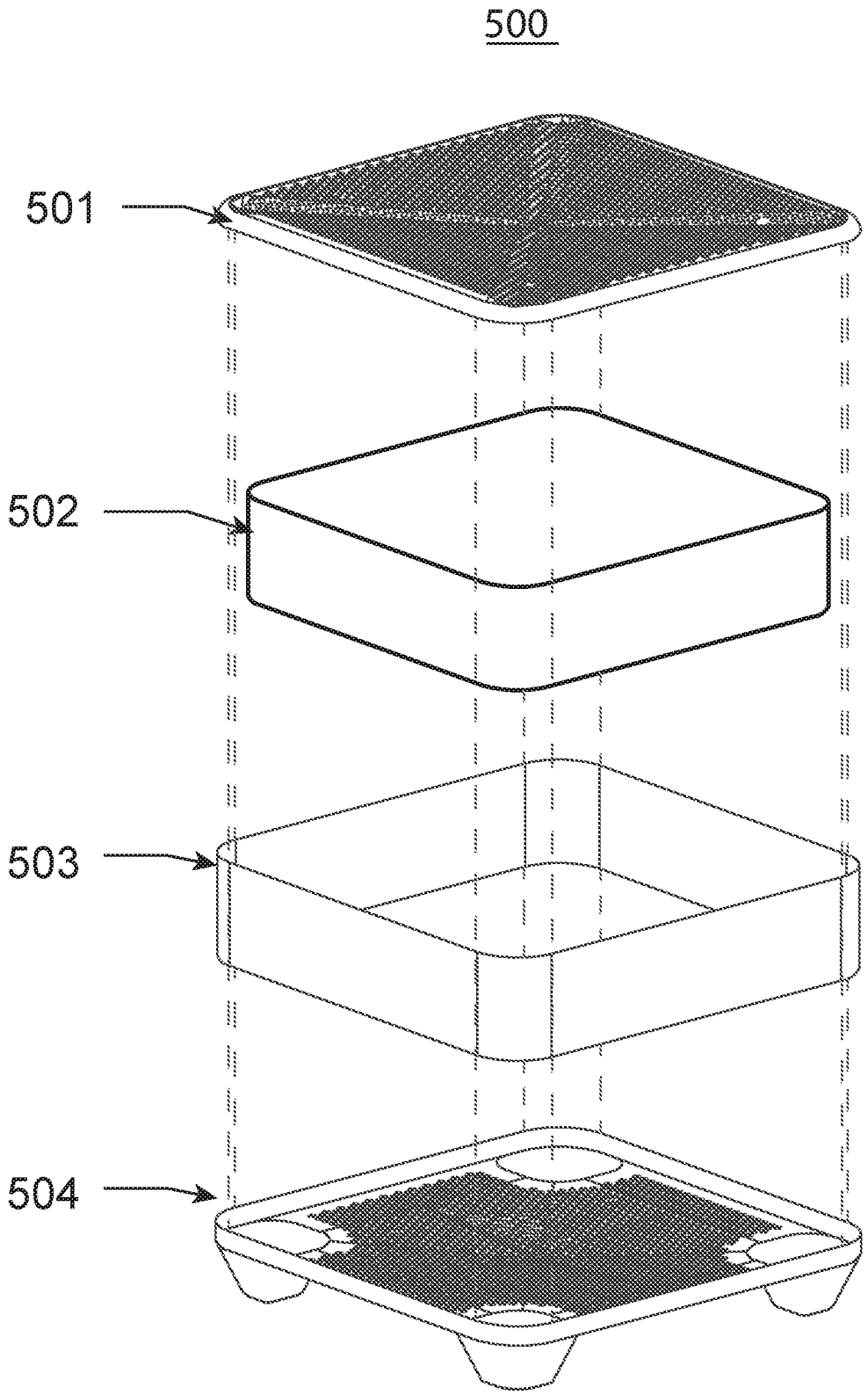
FIG. 5 shows an exploded axonometric projection view of a modular stormwater management device having a protective cover and a perforated base with integrated feet according to an embodiment of the present invention.

FIG. 5 shows an exploded axonometric projection view of a modular stormwater management device 500 having a protective cover 501 and a perforated base with integrated feet 504 according to an embodiment of the present invention. The protective cover 501 clips into a side frame 503 which subsequently clips into the perforated base with integrated feet 504. The protective cover 501 may be made of a rigid material, such as metal, molded of formed plastic, wood, or in some cases stone or engineered stone, and may have perforations that allow for rainwater to flow into the modular stormwater management device 500. The water is then absorbed by a water retention mat 502 which holds the water until after the rain event and releases the water later by evaporation through perforations above and below and/or by dripping slowly out of the perforated base 504. The water retention mat 502 may be constructed as described above with respect to the water retention mat 101. A filter fabric may be incorporated in either the protective cover 501 or the water retention mat 502 in order to improve the life of the water retention mat 502.

The side frame 503 according to an embodiment may be made of a rigid sheet material such as metal or plastic and may support the protective cover 501 and ensure that the protective cover 501 sits above the water retention mat 502, allowing air to circulate between the protective cover 501 and the water retention mat 502. The perforated base 504 may be made of a rigid material such as metal or molded or formed plastic and may be perforated to allow water to drip out of the base and to allow air circulation underneath the water retention mat 502. The perforated base 504 may be configured with integrated feet that lift the water retention mat 502 above the installation surface by several inches.

According to an embodiment, the protective cover 501, side frame 503, and perforated base 504 may be structured to be easily broken down for shipping and then assembled onsite. According to another embodiment, the modular stormwater management device 500 optionally may be structured such that pedestrians or vehicles may move over the modular stormwater management device 500 without crushing the water retention mat 100. Such a configuration may be selected for ground-level uses of the modular stormwater management device 500. The protective cover 501 may shade the water retention mat 502 from solar/UV radiation that may shorten the life of the water retention mat 502. The protective cover 501 and the perforated base 504 may be sloped to further encourage water to enter the water retention mat 502 and to prevent pooling of water on their surfaces, according to an embodiment. The sloped folds may also add rigidity, allowing these components to be made of lighter materials. The protective cover 501 and the perforated base 504 according to an embodiment may have a high ratio of openness to surface area due to their perforations, to enhance the air circulation through the water retention mat 502 and to minimize the weight of the modular stormwater management device 500.

Figure 6:
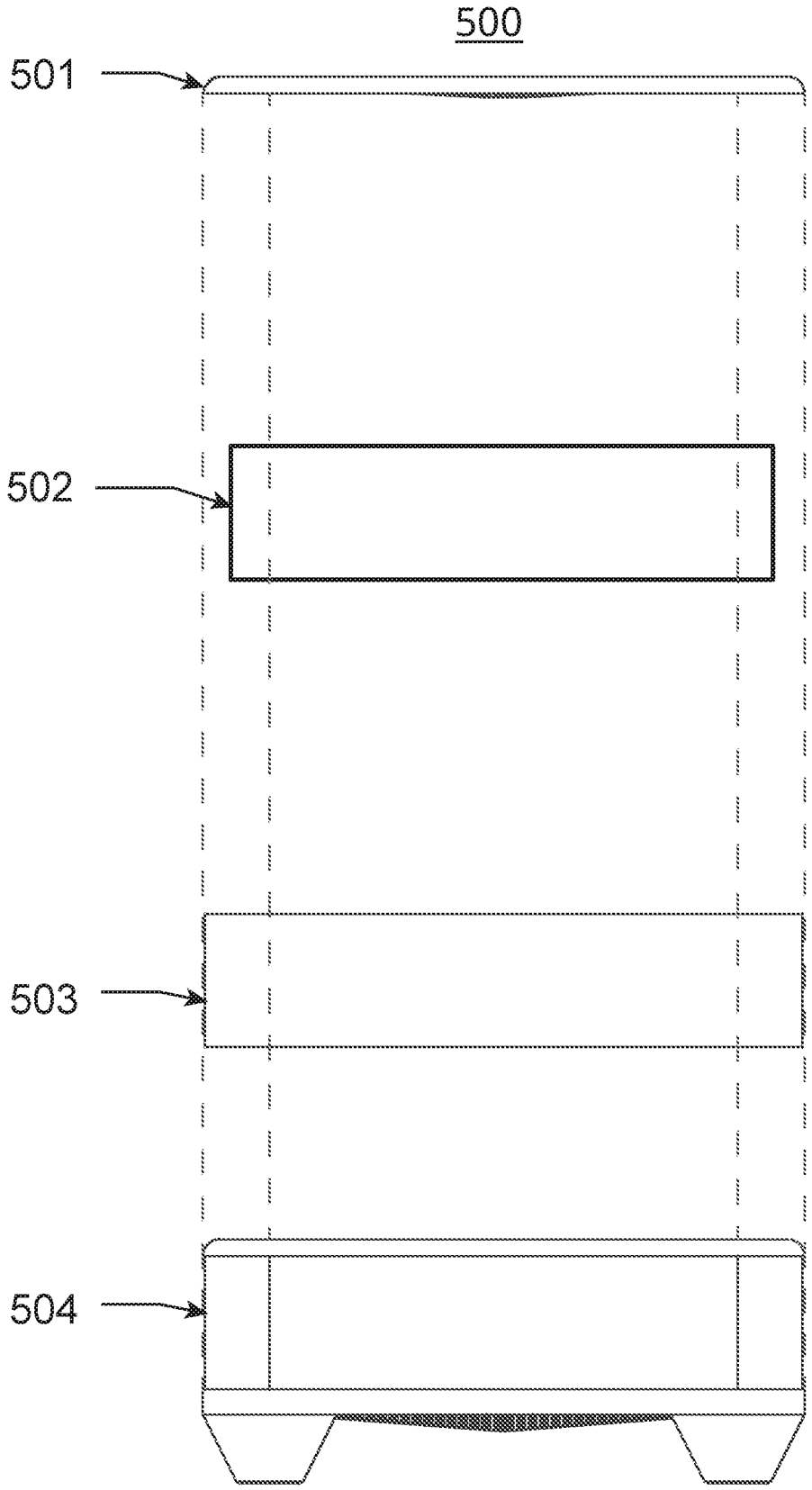
FIG. 6 shows an exploded elevation view of a modular stormwater management device having a protective cover and a perforated base with integrated feet according to an embodiment of the present invention.

FIG. 6 shows an exploded elevation view of a modular stormwater management device 500 having a protective cover 501 over a water retention mat 502 and a perforated base with integrated feet 504 according to an embodiment of the present invention. The water retention mat 502 may be smaller than the side frame 503 in order to ensure air circulation around the water retention mat 502. The side frame 503 may be structured to support the protective cover 501 and prevents it from resting directly on the water retention mat 502. The perforated base with integrated feet 504 may support the modular stormwater management device 500 and lift it off of the surface on which it is installed by several inches. This ensures enough air circulation underneath the water retention mat 502 and prevents the water retention mat 502 from sitting in a pool of water if installed in a flat or depressed area of the surface.

Figure 7:
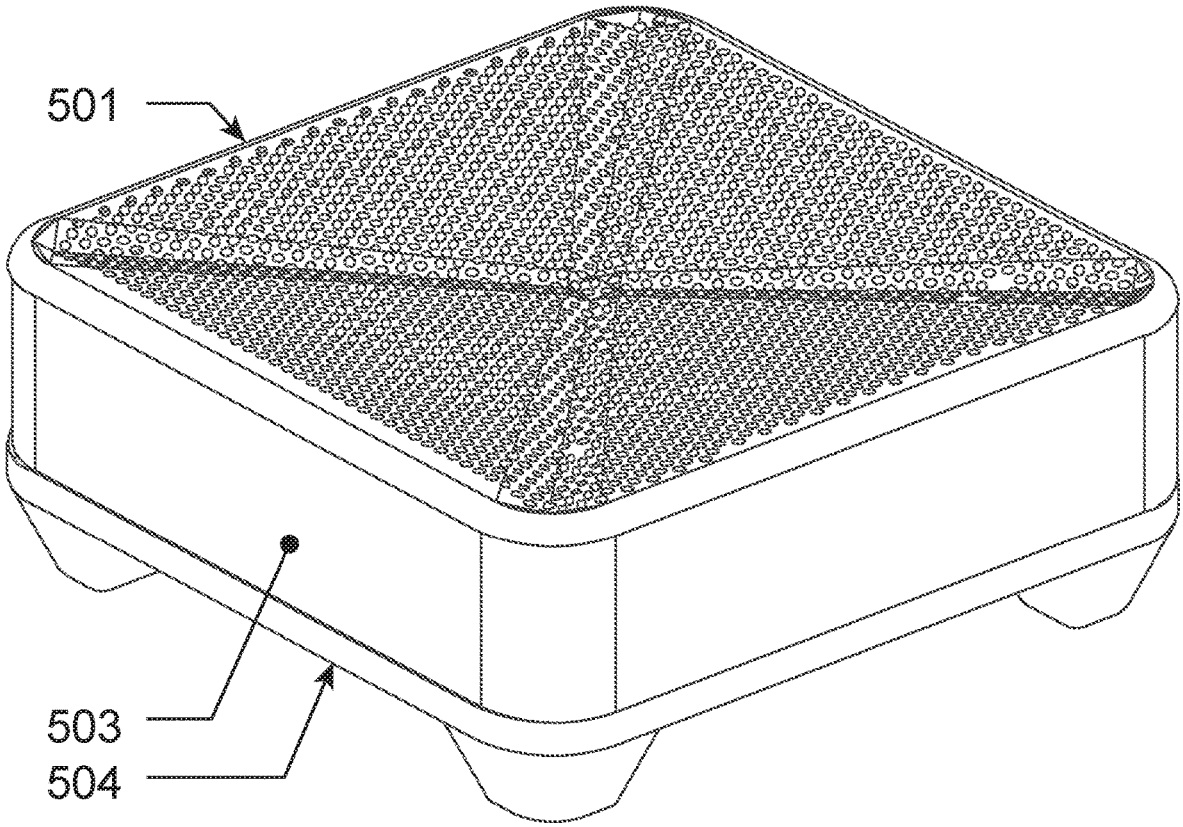
FIG. 7 shows an axonometric projection view of a modular stormwater management device having a protective cover and a perforated base with integrated feet according to an embodiment of the present invention.

FIG. 7 shows an axonometric projection view of a modular stormwater management device 500 having a protective cover 501 and a perforated base with integrated feet 504 according to an embodiment of the present invention. The water retention mat 502 is not visible in FIG. 7 as it is contained within the perforated base 504, side frame 503, and protective cover 501. These modular stormwater management devices 500 may be placed individually or in multiples to cover the desired amount of surface area. The dimensions of the modular stormwater management devices 500 and the number of modular stormwater management devices 500 arrayed may vary based on the application.

Figure 8:
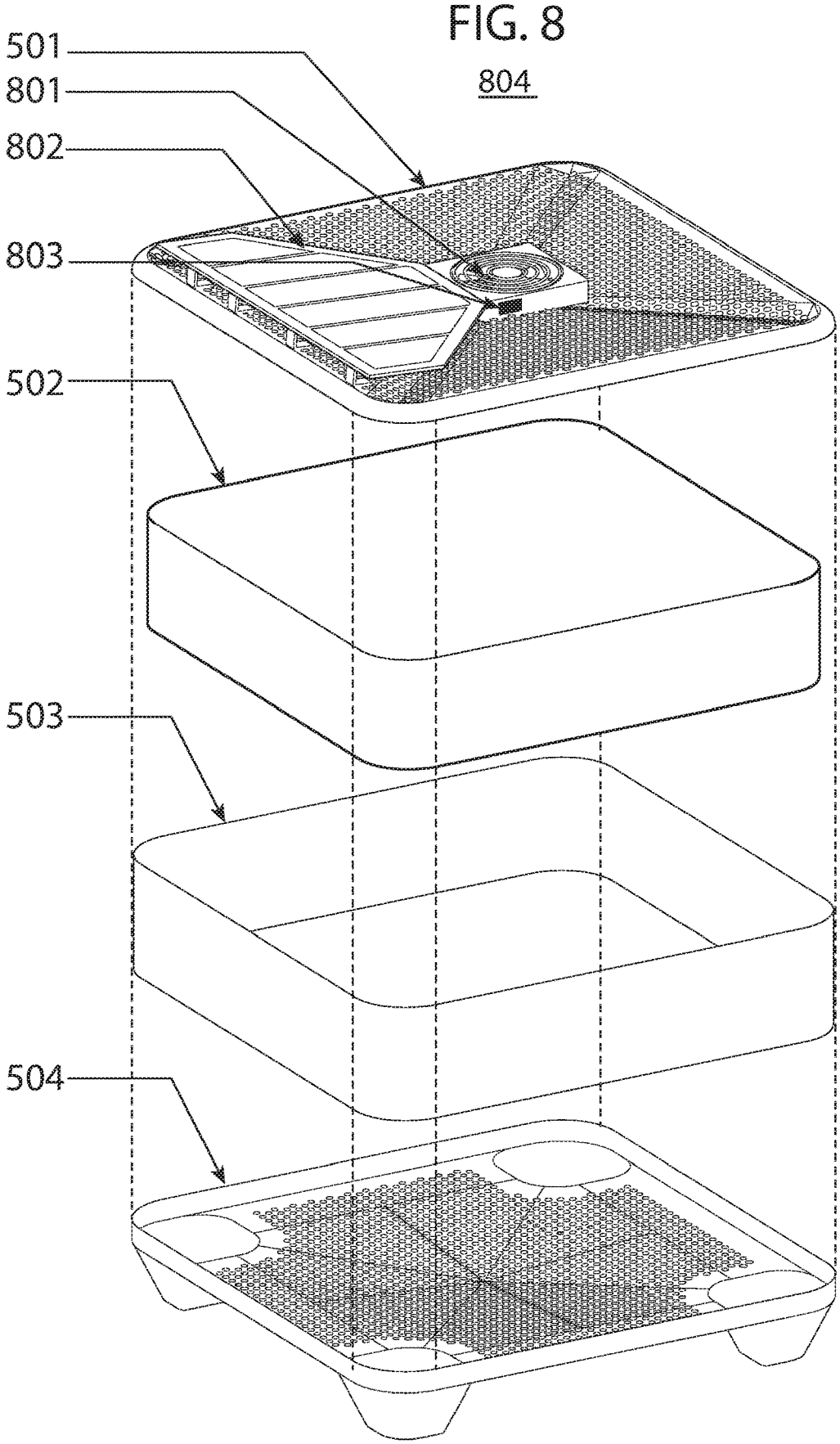
FIG. 8 shows an axonometric projection view of a modular stormwater management device having a protective cover and a perforated base with integrated feet as well as an integrated fan powered by photovoltaic panels according to an embodiment of the present invention.

FIG. 8 shows an axonometric projection view of a modular stormwater management device 804 having a protective cover 501 and a perforated base with integrated feet 504 as well as an integrated fan 801 powered by photovoltaic panels 803 according to an embodiment of the present invention. The integrated fan 801 may be solar powered by the photovoltaic panels 803 which avoid the need for the fan to be connected to an existing electrical system. The integrated fan 801, which may be constructed of either metal or plastic, may be controlled by a moisture sensor 803 and may be configured to activate after a rain event to enhance airflow around the water retention mat 502. The enhanced airflow may speed the rate at which water is evaporated. Climatic considerations, such as humid environments or climates in which several rain events follow in quick succession, may increase the need for faster evaporation of the water retention mat 502.

Figure 9:
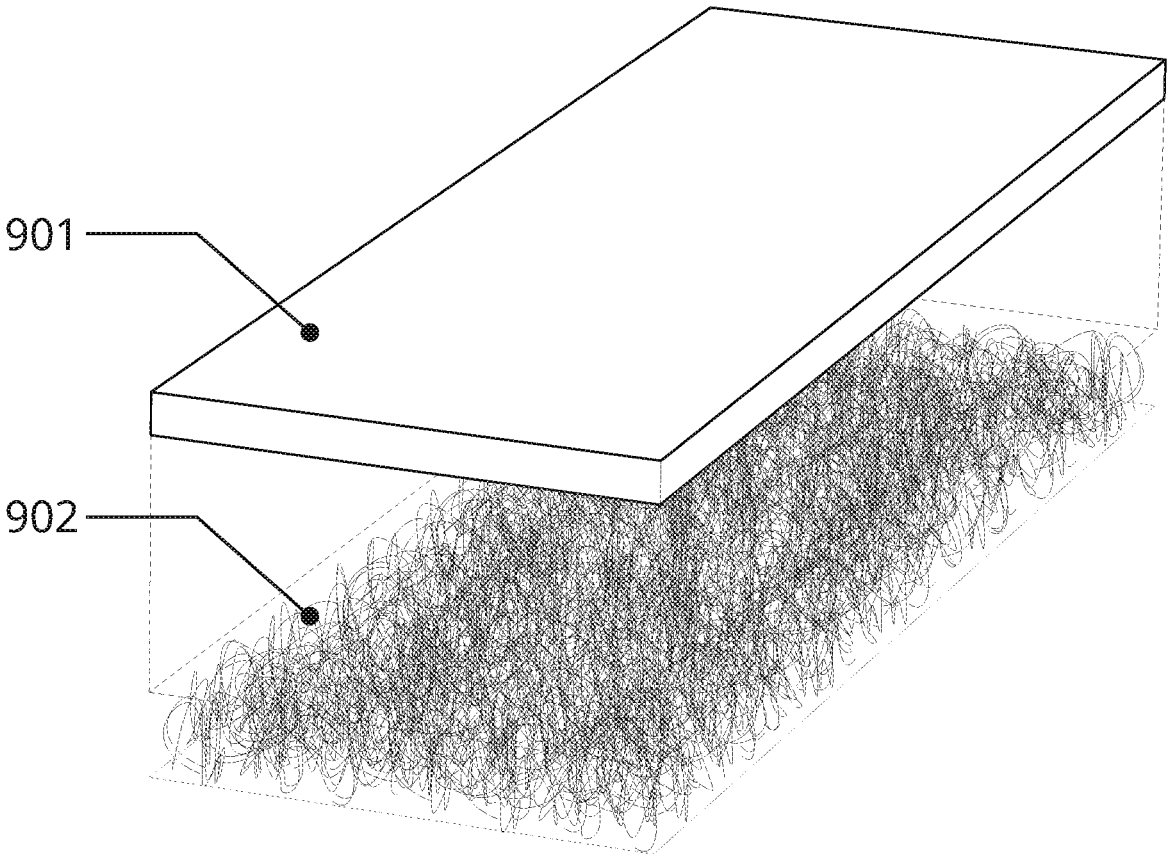
FIG. 9 shows an exploded axonometric projection view of a modular stormwater management device having a water retention mat laminated to a breather fabric that may be applied by rolling it out onto a surface according to an embodiment of the present invention.

FIG. 9 shows an exploded axonometric projection view of a modular stormwater management device 900 having a water retention mat 901 laminated to a breather fabric 902 that may be applied by rolling the modular stormwater management device 900 out onto a surface, according to an embodiment of the present invention. The water retention mat 901 may be made of the same material as described above with respect to the retention mat 101. This embodiment does not rely on a rigid frame to hold the water retention mat 901 several inches off of the surface. Instead, the breather fabric 902 supports the water retention mat 901 and allows for adequate ventilation underneath the retention mat. Though shown separated in FIG. 9 for clarity, the water retention mat 901 and the breather fabric 902 may be laminated together as one material.

The breather fabric 902 may be a synthetic three-dimensional matrix of fibers that allows for air to flow behind the water retention mat 901 that the breather fabric 902 supports. As a non-limiting example, the breather fabric 902 may be made from Cedar Breather® which is produced by Benjamin Obdyke for use behind cedar siding applications. According to an embodiment, the breather fabric 902 may be a minimum of 1½" thick and may be laminated to the water retention mat 901.

Figure 10:
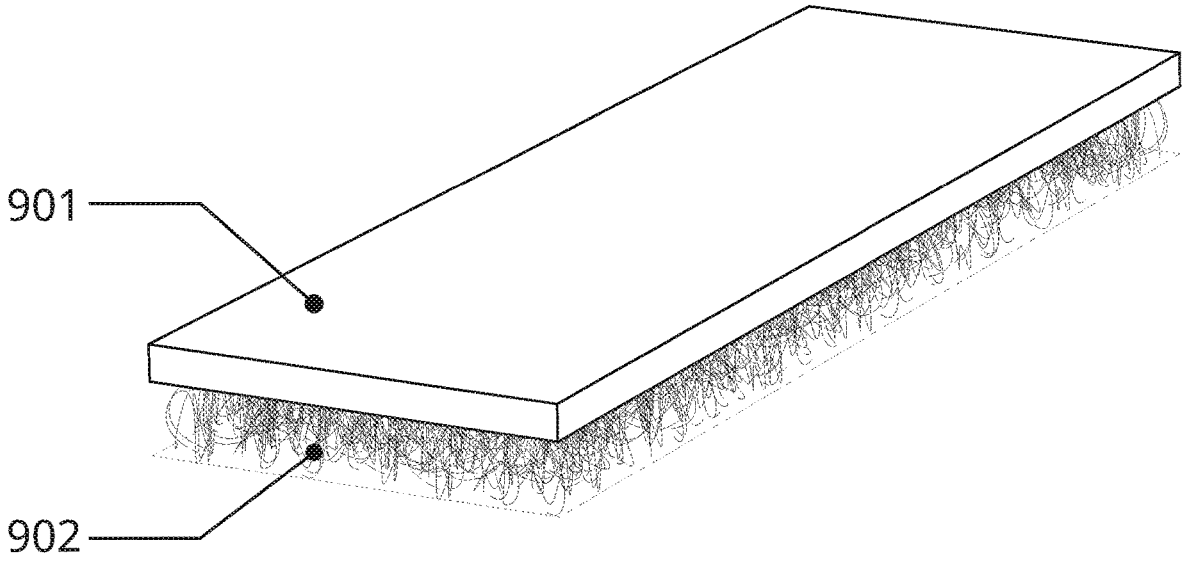
FIG. 10 shows an axonometric projection view of a modular stormwater management device having a water retention mat laminated to a breather fabric that may be applied by rolling it out onto a surface according to an embodiment of the present invention.

FIG. 10 shows an axonometric projection view of the modular stormwater management device 900 having the water retention mat 902 laminated to the breather fabric 902 that may be applied by rolling it out onto a surface, according to an embodiment of the present invention. FIG. 10 shows the water retention mat 901 and the breather fabric 902 laminated together and applied on a roof. The dimensions of the modular stormwater management device 900 may vary. According to an embodiment, the modular stormwater management device 900 may be provided in a standard width, for example, 2 foot wide, 4 foot wide, or 8 foot wide, and the length may be cut to fit onsite. The total length provided in a roll of the modular stormwater management device 900 may vary based on the thickness of the water retention mat 901 and the desirability of specific lengths.

Figure 11:
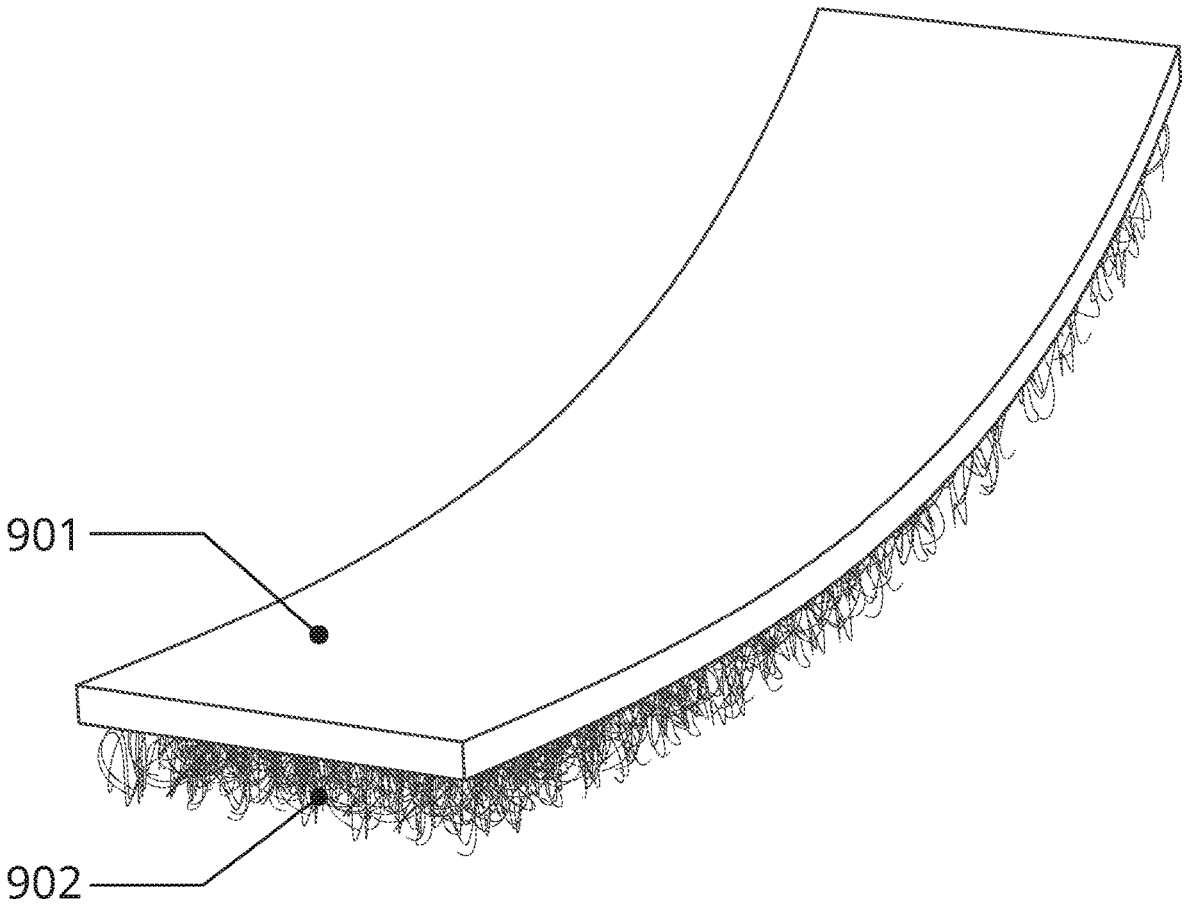
FIG. 11 shows an axonometric projection view of a modular stormwater management device having a water retention mat laminated to a breather fabric that may be applied by rolling it out onto a surface according to an embodiment of the present invention.

FIG. 11 shows an axonometric projection view of a modular stormwater management device 900 having a water retention mat 901 laminated to a breather fabric 902 that may be applied by rolling it out onto a surface according to an embodiment of the present invention. FIG. 11 illustrates how the laminated modular stormwater management device 900 is flexible and may be rolled directly onto an application surface. This alternative embodiment of the modular stormwater management device 900 may be used underneath raised decking, either at ground level or on roofs, in order to easily install a modular stormwater management system 200 underneath an existing surface to catch water that would otherwise flow directly into the stormwater system.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A modular stormwater management device comprising:
a water retention mat structured to absorb stormwater;
a rigid frame structured to support the water retention mat; and
a perforated surface in contact with a bottom surface of the water retention mat and structured to promote drainage of the stormwater from the water retention mat through the perforated surface,
wherein:
the modular stormwater management device is structured to prevent water from pooling therein,
the perforated surface is held within the rigid frame and is further structured to support the water retention mat in a position such that air circulates below the water retention mat, and
a surface area of openings in the perforated surface is greater than a surface area of the perforated surface.

2. The modular stormwater management device according to claim 1, wherein the water retention mat is further structured to hold the absorbed stormwater until the absorbed stormwater is dissipated through drainage and evaporation.

3. The modular stormwater management device according to claim 1, wherein the rigid frame supports the water retention mat in a position such that air circulates above and below the water retention mat.

4. The modular stormwater management device according to claim 1, further comprising at least one pedestal structured to support the rigid frame and water retention mat above an installation surface.

5. The modular stormwater management device according to claim 1, wherein the rigid frame comprises at least one integrated pedestal structured to support the water retention mat above an installation surface.

6. The modular stormwater management device according to claim 5, wherein the at least one integrated pedestal is further structured to accommodate a sloped surface as the installation surface.

7. The modular stormwater management device according to claim 5, further comprising a perforated protective cover arranged above the water retention mat.

8. The modular stormwater management device according to claim 7, wherein the perforated protective cover slopes downward from edges to a center portion of the perforated protective cover such that the stormwater is directed towards the water retention mat.

9. The modular stormwater management device according to claim 7, wherein the perforated protective cover and rigid frame comprising the at least one integrated pedestal are structured to support weight of pedestrians.

10. The modular stormwater management device according to claim 1, further comprising a perforated protective cover arranged above the water retention mat.

11. The modular stormwater management device according to claim 10, wherein the rigid frame is further structured to support the perforated protective cover above the water retention mat.

12. The modular stormwater management device according to claim 10, wherein the perforated protective cover and rigid frame are structured to support weight of pedestrians.

13. The modular stormwater management device according to claim 1, wherein the water retention mat is formed from a material that is resistant to degradation due to solar radiation.

14. A modular stormwater management device comprising:
a water retention mat structured to absorb stormwater;
a rigid frame structured to support the water retention mat;
a perforated surface in contact with a bottom surface of the water retention mat and structured to promote drainage of the stormwater from the water retention mat through the perforated surface; and
a perforated protective cover arranged above the water retention mat,
wherein:
the modular stormwater management device is structured to prevent water from pooling therein,
the perforated surface is held within the rigid frame and is further structured to support the water retention mat in a position such that air circulates below the water retention mat, and
the perforated protective cover slopes downward from edges to a center portion of the perforated protective cover such that the stormwater is directed towards the water retention mat.

15. A modular stormwater management device comprising:
a water retention mat structured to absorb stormwater;
a rigid frame structured to support the water retention mat;
a perforated surface structured to permit drainage of the stormwater from the water retention mat through the perforated surface; and
a photovoltaic powered fan arranged to enhance airflow around the water retention mat,
wherein a surface area of openings in the perforated surface is greater than a surface area of the perforated surface.

* * * * *